US007306682B2

(12) United States Patent
Yoshinari et al.

(10) Patent No.: US 7,306,682 B2
(45) **Date of Patent: *Dec. 11, 2007**

(54) SINGLE-CRYSTAL NI-BASED SUPERALLOY WITH HIGH TEMPERATURE STRENGTH, OXIDATION RESISTANCE AND HOT CORROSION RESISTANCE

(75) Inventors: Akira Yoshinari, Hitachinaka (JP); Ryokichi Hashizume, Ouji-cho (JP); Masahiko Morinaga, Nagoya (JP); Yoshinori Murata, Nagoya (JP)

(73) Assignees: Hitachi, Ltd., Tokyo (JP); The Kansai Electric Power Co., Inc., Osaka-shi (JP); Masahiko Morinaga, Nagoya-shi (JP); Yoshinori Murata, Nagoya-shi (JP)

( * ) Notice: Subject to any disclaimer, the term of this patent is extended or adjusted under 35 U.S.C. 154(b) by 464 days.

This patent is subject to a terminal disclaimer.

(21) Appl. No.: 10/914,502

(22) Filed: Aug. 10, 2004

(65) Prior Publication Data

US 2005/0067062 A1 Mar. 31, 2005

(30) Foreign Application Priority Data

Aug. 11, 2003 (JP) ..... 2003-207144

(51) Int. Cl.
*C22C 19/05* (2006.01)

(52) U.S. Cl. ..... 148/428; 420/443; 420/444; 420/448

(58) Field of Classification Search ..... 148/410, 148/428; 420/443, 444, 448
See application file for complete search history.

(56) References Cited

U.S. PATENT DOCUMENTS

| | | | | |
|---|---|---|---|---|
| 5,443,789 | A * | 8/1995 | Harris et al. | 420/443 |
| 5,660,649 | A * | 8/1997 | Bornstein et al. | 148/404 |
| 5,888,451 | A | 3/1999 | Konter et al. | |
| 6,419,763 | B1 * | 7/2002 | Konter et al. | 148/404 |
| 2006/0039820 | A1 * | 2/2006 | Darolia et al. | 420/444 |

FOREIGN PATENT DOCUMENTS

| | | | |
|---|---|---|---|
| EP | 1 038 982 | A1 | 9/2000 |
| GB | 2 235 697 | A | 3/1991 |
| JP | 05-059474 | | 3/1993 |
| JP | 07-138683 | | 5/1995 |
| JP | 7-278709 | A | 10/1995 |
| JP | 2000-512341 | A | 9/2000 |
| JP | 2003-129155 | A | 5/2003 |

OTHER PUBLICATIONS

Japanese Office Action dated Jul. 3, 2007 (three (3) pages).

* cited by examiner

*Primary Examiner*—George Wyszomierski
(74) *Attorney, Agent, or Firm*—Crowell & Moring LLP

(57) ABSTRACT

An object of this invention is to provide a single-crystal nickel-based superalloy having high creep rupture strength at high temperatures and excel at corrosion resistance and oxidation resistance at high temperatures.

Single-crystal nickel-based superalloys with high temperature strength, hot corrosion resistance and oxidation resistance comprising by weight, 3.0 to 7.0% Cr, 9.5 to 15.0% Co, 4.5 to 8.0% W, 3.3 to 6.0% Re, 4.0 to 8.0% Ta, 0.8 to 2.0% Ti, 4.5 to 6.5% Al, 0.01 to 0.2% Hf, less than 0.5% Mo, 0.01% or less C, 0.005% or less B, 0.01% or less Zr, 0.005% or less O, 0.005% or less N, and balance substantially Ni.

12 Claims, 4 Drawing Sheets

SINGLE-CRYSTAL NI-BASED SUPERALLOY WITH HIGH TEMPERATURE STRENGTH, OXIDATION RESISTANCE AND HOT CORROSION RESISTANCE

BACKGROUND OF THE INVENTION

1. Field of the Invention

This invention relates to a novel single-crystal nickel-based superalloy with high temperature strength, hot corrosion resistance and oxidation resistance.

2. Description of the Prior Art

Recently, power engines such as jet engines and gas turbines have necessarily been used at high turbine inlet temperatures to increase their performance and efficiency. Therefore, we inventors have thought it is very important to develop turbine blade materials that are resistant to such high temperatures.

Major properties required for the turbine blade materials are high creep rupture strength and ductility that can withstand centrifugal forces at high temperatures and high oxidation resistance and hot corrosion resistance to hot combustion gas atmosphere. To satisfy these requirements, nickel-based single-crystal superalloys have been expected hopefully and have stepped toward the practical use.

Unlike conventional casting alloys (ex-axis grain) and unidirectional solidification alloys, the single-crystal articles of nickel-based superalloy have no grain boundaries and can be solution-treated just under the solidus temperature. Therefore, we can get a uniform macrostructure completely free from the segregation. The nickel-based single crystal superalloys have much higher in the creep rupture strength and ductility than the conventional cast nickel based superalloys. The solution heat-treatment just under the solidus temperature allows the alloys to contain more solution hardening elements than the conventional cast alloys. Namely, single crystal superalloys have a feature of containing a lot of W and Ta which have high solution hardening abilities and increasing the creep rupture strength.

Japanese Application Laid-open Publication No. 07-138683 discloses a single-crystal nickel-based superalloy comprising by weight, 1.8 to 4.0% Cr, 1.5 to 9.0% Co, 3.5 to 7.5% W, 5.0 to 7.0% Re, 7.0 to 10.0% Ta, 0.1 to 1.2% Ti, 5.0 to 7.0% Al, 0.25 to 2.0% Mo, 0 to 0.5% Nb and 0 to 0.15% Hf.

In recent years, single-crystal nickel-based superalloys as disclosed by Japanese Application Laid-open Publication No. 07-138683 has been developed actively and a lot of alloys have been invented. However, these alloys have been developed focusing mainly on improving their creep rupture strength at high temperatures, whereas their hot corrosion resistance and oxidation resistance have been considered little.

Increasing the content of Cr or Re is most effective in improving the hot corrosion resistance of the alloy. However, a large amount of chromium (Cr) in the alloy reduces the solubility limit of elements such as W and Ta having high solution hardening abilities and cannot increase the creep rupture strength of the alloy. In contrast to Cr, rhenium (Re) improves the hot corrosion resistance but drastically reduces the oxidation resistance of the alloy at high temperatures. Therefore, all of these properties (high temperature strength, hot corrosion resistance and oxidation resistance) are not satisfied in nickel-based superalloys developed so far.

SUMMARY OF THE INVENTION

An object of this invention is to provide a single-crystal nickel-based superalloy with high creep rupture strength, corrosion resistance and oxidation resistance at temperatures.

In accordance with this invention, the single-crystal nickel-based superalloy with high temperature strength, hot corrosion resistance and oxidation resistance is characterized by comprising by weight, 3.0 to 7.0% Cr, 9.5 to 15.0% Co, 4.5 to 8.0% W, 3.3 to 6.0% Re, 4.0 to 8.0% Ta, 0.8 to 2.0% Ti, 4.5 to 6.5% Al, 0.01 to 0.2% Hf, less than 0.5% Mo, 0.01% or less C, 0.005% or less B, 0.01% or less Zr, 0.005% or less O, 0.005% or less N, and balance substantially Ni.

In accordance with this invention, the single-crystal nickel-based superalloy with high temperature strength, hot corrosion resistance and oxidation resistance is characterized by comprising by weight, 3.5 to 7.0 Cr, 10.1 to 13.5 Co, 4.5 to 8.0 W, 3.3 to 5.5 Re, 6.1 to 8.0 Ta, 1.0 to 2.0 Ti, 4.5 to 6.5 Al, 0.03 to 0.15 Hf, less than 0.5 Mo, 0.01 or less C, 0.005 or less B, 0.01 or less Zr, 0.005 or less O, 0.005 or less N, and balance substantially Ni.

In accordance with this invention, the single-crystal nickel-based superalloy with high temperature strength, hot corrosion resistance and oxidation resistance is characterized by comprising by weight, 3.8 to 6.8 Cr, 10.1 to 12.5 Co, 4.8 to 7.0 W, 3.3 to 4.9 Re, 6.1 to 8.0 Ta, 1.2 to 1.8 Ti, 4.5 to 6.5 Al, 0.03 to 0.15 Hf, less than 0.5 Mo, 0.01 or less C, 0.005 or less B, 0.01 or less Zr, 0.005 or less O, 0.005 or less N, and balance substantially Ni.

In accordance with this invention, the single-crystal nickel-based superalloy with high temperature strength, hot corrosion resistance and oxidation resistance is characterized by comprising by weight, 3.8 to 6.8 Cr, 10.1 to 12.5 Co, 4.8 to 7.0 W, 3.3 to 4.9 Re, 6.1 to 8.0 Ta, 1.2 to 1.8 Ti, 4.5 to 6.5 Al, 0.03 to 0.15 Hf, less than 0.1 Mo, 0.01 or less C, 0.005 or less B, 0.01 or less Zr, 0.005 or less O, 0.005 or less N, and balance substantially Ni.

A single-crystal nickel-based superalloy with high temperature strength, hot corrosion resistance and oxidation resistance of any of claims 1 to 4, wherein the Mdt value obtained by atomic fractions of the elements is 0.975 to 0.995 and the Bo value is 0.650 to 0.675.

$$Mdt=1.142\times(Cr)+0.777\times(Co)+1.655\times(W)+1.550\times(Mo)+1.267\times(Re)+2.224\times(Ta)+2.271\times(Ti)+1.900\times(Al)+0.717\times(Ni)$$

$$Bo=1.278\times(Cr)+0.697\times(Co)+1.730\times(W)+1.611\times(Mo)+1.692\times(Re)+1.670\times(Ta)+1.098\times(Ti)+0.533\times(Al)+0.514\times(Ni)$$

In addition to the above composition, the single-crystal nickel-based superalloy with high temperature strength, hot corrosion resistance and oxidation resistance comprises 1 to 500 ppm of rare-earth elements, more preferably 10 to 50 ppm. Furthermore, the rare-earth elements are preferably Y or Ce.

Below we will explain the reasons for limited component ranges and preferable component ranges of the single-crystal nickel-based superalloy with high temperature strength, hot corrosion resistance and oxidation resistance in accordance with this invention.

3.0 to 7.0% by Weight of Cr

Chromium is an element to improve the corrosion resistance of alloys at high temperatures. The striking effect of chromium appears when more than 3.0% by weight of chromium is added to the alloy. As the content of chromium increases, the corrosion resistance becomes high, but the solubility limits of the solution hardening elements becomes small, resulting in precipitating TCP phases which is a brittle phase. As a result, both high temperature strength and hot corrosion resistance of the alloy are deteriorated. Therefore, to keep the high temperature strength and hot corrosion resistance of the alloy, the content of chromium must be up to 7.0% by weight. In order to keep a good balance between high temperature strength and hot corrosion resistance of nickel-based superalloys, the content of chromium must be 3.5 to 7.0% by weight, preferably 3.8 to 6.8% by weight.

9.5 to 15.0% by Weight of Co

Cobalt has effects to reduce the solves temperature of the γ' phase ($Ni_3Al$, which is an inter-metallic compound of Ni and Al), to facilitate solution heat treatment, to solution-harden the γ phase, and to improve the creep rupture strength and the hot corrosion resistance of nickel-based superalloys. For the effects, the suitable content of cobalt is 9.5% or more by weigh. However, when the content of cobalt exceeds 15.0% by weight in the alloys, it suppresses precipitation of the γ' phase as the strengthening phase of the superalloys, resulting in decreasing the high temperature strength of the alloys. Therefore, the content of cobalt must be 15.0% or less by weight. In order to keep a good balance between facilitation of the solution heat treatment and high temperature strength of the alloys, the content of cobalt must be 10.1 to 13.5% by weight, preferably 10.1 to 12.5% by weight.

4.5to 8.0% by Weight of W

Tungsten dissolves in both the γ phase which is the matrix and the γ' phase which is the precipitation phase and increases the creep rupture strength by the solution hardening. To get this hardening effect, the content of tungsten must be 4.5% or more by weight. However, tungsten has a great specific gravity, makes the alloy heavier, and reduces the hot corrosion resistance of the nickel-based superalloys. When the content of tungsten exceeds 8.0% by weight in the alloy, needle-like alpha-tungsten phase precipitates in the alloy. This phase deteriorates the creep rupture strength, hot corrosion resistance, and ductility of the alloy. Therefore, the content of tungsten in the alloy must be up to 8.0% by weight. In order to keep high temperature strength, corrosion resistance, and phase stability of the alloy at high temperatures, the content of tungsten must preferably be 4.8 to 7.0% by weight.

3.3 to 6.0% by Weight of Re

Rhenium dissolves almost completely in the γ phase which is the matrix, increases the creep rupture strength by the solution hardening and improve the hot corrosion resistance of the alloy. To get these effects, the content of rhenium must be 3.3% or more by weight. However, rhenium is expensive, great in specific gravity, and makes the alloy heavier. When the content of rhenium exceeds 6.0% by weight, in the alloy, needle-like alpha-tungsten or alpha-rhenium phase precipitates in the alloy. This phase deteriorates the creep rupture strength and ductility of the alloy. Therefore, the content of rhenium in the alloy must be up to 6.0% by weight. In order to keep high temperature strength, hot corrosion resistance, and phase stability of the alloy at high temperatures, the content of tungsten must be 3.3 to 5.5% by weight preferably 3.3 to 4.9% by weight.

4.0 to 8.0% by Weight of Ta

Tantalum dissolves in the γ' phase as the form of [$Ni_3$(Al, Ta)] and hardens the phase. This improves the creep rupture strength of the alloy. To fully get such an effect, the content of tantalum must be 4.0% or more by weight. When the content of tantalum exceeds 8.0% by weight in the alloy, needle-like delta-phase [Ni, Ta] precipitates in the alloy. This phase deteriorates the creep rupture strength of the alloy. Therefore, the content of tantalum in the alloy must be up to 6.0% by weight. In order to keep high temperature strength and phase stability of the alloy at high temperatures, the content of tantalum must preferably be 6.1 to 8.0% by weight.

0.8 to 2.0% by Weight of Ti

Titanium as well as tantalum dissolves in the γ' phase as the form of [$Ni_3$ (Al, Ta, Ti)] and hardens the phase, but it is less effective than tantalum. On the other hand, titanium has an effect to improve the hot corrosion resistance of the alloy. To get such an effect, the content of titanium must be 0.8% or more by weight. When more than 2.0% by weight of titanium is added to the alloy, the oxidation resistance of the alloy deteriorates. Therefore, the content of titanium in the alloy must be up to 2.0% by weight. In order to keep high temperature strength, hot corrosion resistance, and oxidation resistance of the alloy at high temperatures, the content of titanium must be 1.0 to 2.0% by weight, preferably 1.2 to 1.8% by weight.

4.5 to 6.5% by Weight of Al

Aluminum is a constituent of the γ' phase [$Ni_3Al$] which is the precipitation hardening phase. This element improves the creep rupture strength of the alloy and also contributes to improve the oxidation resistance of the alloy greatly. To fully get these effects, the content of aluminum must be 4.5% or more by weight. When the content of aluminum exceeds 6.5% by weight, the γ' phase [$Ni_3Al$] precipitates too much. This excess amount of the γ' phase decreases the strength of the alloy. Therefore, the content of aluminum must be 4.5 to 6.5% by weight.

0.01 to 0.2% by Weight of Hf

Hafnium increases the adhesiveness of a protective film (e.g. $Cr_2O_3$ or $Al_2O_3$) to the surface of the alloy, resulting in improving the both hot corrosion resistance and oxidation resistance of the alloy. The content of hafnium must be 0.01% or more by weight in the alloy. When the content of hafnium increases in the alloy, the adhesiveness of the protective film to the alloy surface is improved strikingly. When the content of hafnium exceeds 0.2% by weight, the solidus temperature of the nickel-based superalloy decreases strikingly. Therefore, the content of hafnium must be 0.2% or less by weight to get a suitable temperature range for solution heat treatment. In order to keep hot corrosion resistance, oxidation resistance, and heat treatment temperature range of the alloy, the content of hafnium must be 0.03 to 0.15% by weight.

Less than 0.5% by Weight of Mo

The effect of molybdenum on the alloy is similar to that of tungsten. Then this element can be partially substituted for tungsten. A small amount of molybdenum improves the creep rupture strength because it increases the solution temperature of the γ' phase. Molybdenum has a smaller specific gravity than tungsten and can reduce the weight of the alloy. However, when the content of molybdenum exceeds 0.5% by weight, it reduces the creep rupture strength, oxidation resistance, and hot corrosion resistance of the alloy. Therefore the content of molybdenum must be less than 0.5% by weight in the alloy. In order to keep creep rupture strength, oxidation resistance, and hot corrosion resistance of the alloy, the content of molybdenum must be less than 0.1% by weight and it is more preferable that no molybdenum should be substantially added to the alloy for obtaining good oxidation resistance.

1 to 500 ppm of Rare-Earth Elements

Rare-earth elements increase the adhesiveness of a protective film (e.g. $Cr_2O_3$ or $Al_2O_3$) to the surface of alloy. As a result, hot corrosion resistance and oxidation resistance of the alloy are improved. The content of rare-earth elements must be 1 ppm or more in the alloy to improve the adhesiveness of the protective film to the alloy surface. However, when the content of rare-earth elements exceeds 500 ppm. It strikingly reduces the solidus temperature of the nickel-based heat-resistant superalloys. Therefore, the content of rare-earth elements must be 500 ppm or less to get a suitable temperature range for the solution heat treatment. In order to keep hot corrosion resistance, oxidation resistance, resistance to the reactivity of the alloy with casting molds, and heat treatment temperature range of the alloy, the content of rare-earth elements must preferably be 10 to 50 ppm. Although every rare-earth element increase the adhesiveness of a protective film to the surface of alloy, the effects of cerium (Ce) and yttrium (Y) are more remarkable. Cerium (Ce) and yttrium (Y) are cheaper than the other rare-earth elements and then suitable as additives to practical alloys.

0.01% or Less by Weight of C, 0.005% or Less by Weight of B, and 0.01% or Less by Weight of Zr These elements have been used to strengthen the grain-boundaries in conventional cast nickel-based superalloys and unidirectional solidification alloys. However, the single-crystal nickel-based superalloy does not require these grain-boundary strengthening elements and in some cases, these elements may be harmful to production of the alloys. However, these elements are effective to coat the surface of the alloys. The alloys cannot be free from containing a trace of these elements because these elements are hard to be excluded.

Carbon (C) forms carbides (TiC, TaC, etc.) as the blocky precipitates in nickel-based superalloys as a result of the eutectic reaction of the g γ' phase+carbides. The eutectic reaction showing lower melting points than that of the alloy matrix causes the incipient melting during the solution treatment just under the solidus temperature of the alloy, and hence the solution treatment can not be done by the existence of the eutectic reaction. Namely the carbides narrow the range of solution treatment temperature. In addition, carbon combines with tantalum (Ta) which is one of the solution hardening elements into the gamma-prime phase. This reduces the apparent content of tantalum for the solution hardening and consequently reduces the creep rupture strength of the alloy at high temperatures. Therefore, the upper limit of carbon content is set to be 0.01% by weight. Preferably the content of carbon is 0.0005 to 0.005% by weight.

Boron precipitates as borides [$(Cr, Ni, Ti, Mo)_3B_2$] on the crystal grain boundaries in the alloy. The borides as well as carbides have lower melting points than that of the alloy. This reduces the solution treatment temperature of the single crystals and narrows the range of solution treatment temperature. Therefore, the upper limit of boron content is set to be 0.005% by weight. Preferably the content of boron is 0.0005 to 0.001% by weight.

Zirconium (Zr) forms an inter-metallic compound with nickel (Ni). This compound reduces the melting point of the alloy and consequently reduces the solution treatment temperature of the single crystals. Therefore, the upper limit of zirconium content is set to be 0.01% by weight. Preferably the content of zirconium is 0.0005 to 0.005% by weight.

0.005% or Less by Weight of Si and 0.005% or Less by Weight of Mn

These elements are often brought from impurities of the raw materials for alloys, and they form undesirable compounds having lower melting points than the alloy matrix. These compounds reduce the solution treatment temperature of the single crystals and narrow the range of solution treatment temperature. Therefore, the upper limits of the both contents of silicon and manganese are set to be 0.005% by weight, preferably 0.0005 to 0.003% by weight.

0.005% or Less by Weight of Oxygen (O) and 0.005% or Less by Weight of Nitrogen (N)

These elements are often brought from impurities of the raw materials for alloys. Oxygen is brought from crucibles into the alloys and forms oxides ($Al_2O_3$, etc) and also nitrides (TiN or AlN) are formed in alloys in blocky shape. These oxides and nitrides in the nickel-based single-crystal superalloys cause the crack initiation point during creep deformation of the alloys, resulting in reducing the creep rupture life. Therefore the upper limits of the both contents of oxygen and nitrogen are set to be 0.005% by weight, preferably 0.0001 to 0.001% by weight.

Mdt Value: 0.975 to 0.995

When the nickel-based alloy contains about 60 to 65% by volume of γ phase, the γ/γ' eutectic phase is formed in the inter-dendritic regions by the solidifying segregation. The single-crystal superalloys improve the high temperature creep properties by completely dissolving the γ/γ' eutectic phase by the solution heat treatment just under the solidus temperature. However, if a large amount of the γ/γ' eutectic phase is formed in the alloys by component unbalancing, some part of the γ/γ' eutectic phase remain undissolved even after the solution-treated just under the solidus temperature. This reduces the creep rupture strength. To completely dissolve the eutectic γ/γ' phase in the inventive alloy; the Mdt value obtained by atomic fractions of the elements in the equation below must be 0.995 or less. Further, when the Mdt value is too small, the creep rupture strength reduces. Therefore the lower limit of the Mdt value must be 0.975.

$$Mdt=1.142\times(Cr)+0.777\times(Co)+1.655\times(W)+1.550\times(Mo)+1.267\times(Re)+2.224\times(Ta)+2.271\times(Ti)+1.900\times(Al)+0.717\times(Ni)$$

Bo Value: 0.650 to 0.675

The Bo value is an index indicating the inter-atomic bond. As this value becomes greater, the inter-atomic bonding force becomes stronger and the alloy becomes stronger. However, when this value is too large, harmful phases such as alpha-tungsten and alpha-rhenium precipitate, resulting in reducing the creep rupture strength, ductility, corrosion resistance and so on. To make the alloy of this invention strongest without precipitation of any harmful phase, the Bo value obtained by atomic fractions of the elements in the equation below must be 0.650 to 0.675.

$$Bo=1.278\times(Cr)+0.697\times(Co)+1.730\times(W)+1.611\times(Mo)+1.692\times(Re)+1.670\times(Ta)+1.098\times(Ti)+0.533\times(Al)+0.514\times(Ni)$$

DESCRIPTION OF THE PREFERRED EMBODIMENTS

Figure 1:
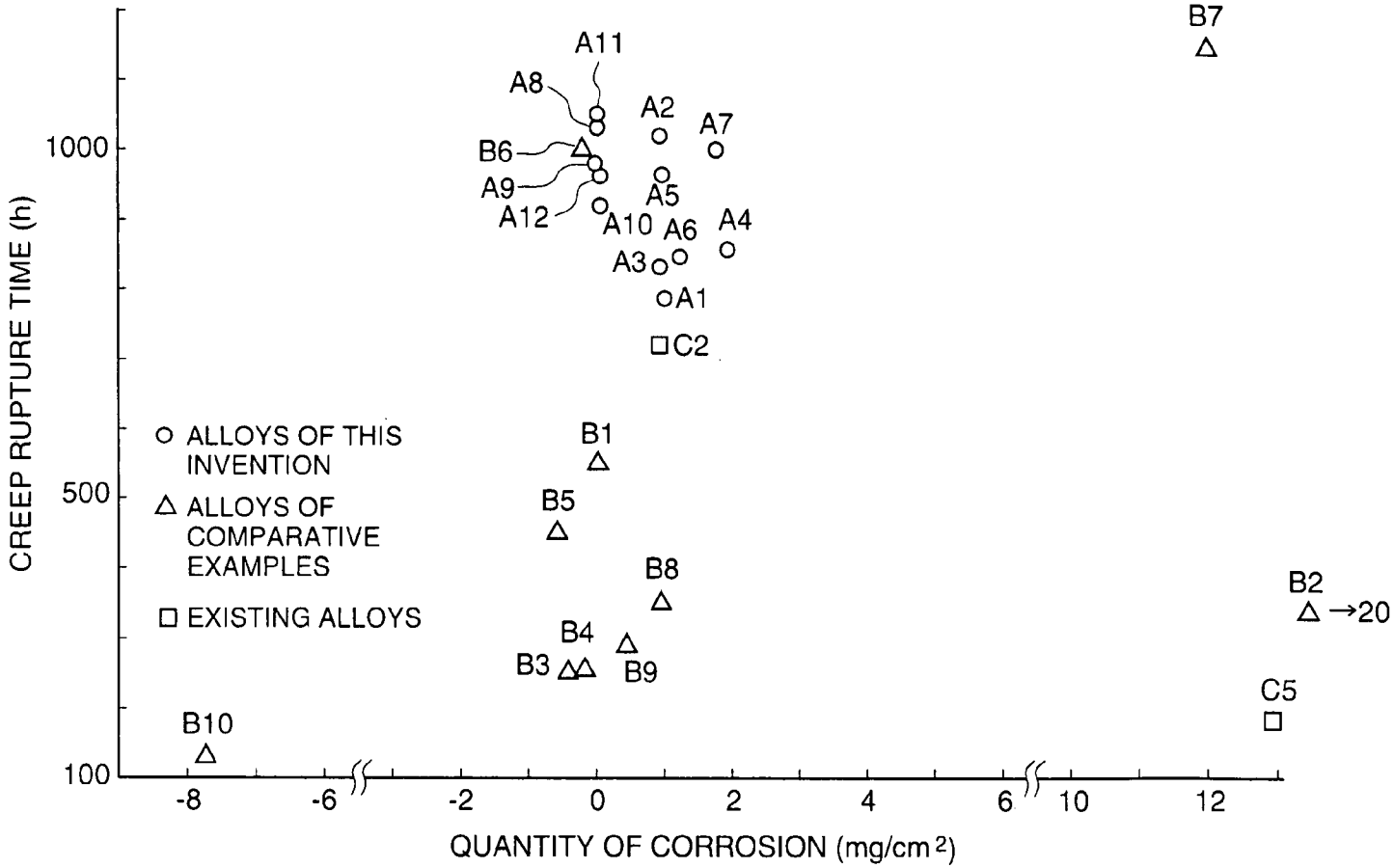
FIG. 1 is a diagram showing the relationship between creep rupture time and quantity of corrosion at 1313 K.

Table 1 lists chemical compositions by weight of major components of alloys of this invention (A1 to A12), alloys of comparative examples (B1 to B10) and existing alloys (C1 to C6) for reference. As shown in Table 1, the alloys of this invention (A1 to A12) have Mdt values of 0.975 to 0.995 and Bo values of 0.650 to 0.675, respectively.

TABLE 1

| | | Alloy composition (% by weight) | | | | | | | | | | | | |
|---|---|---|---|---|---|---|---|---|---|---|---|---|---|---|
| Type | No. | Ti | Cr | Co | Ni | Mo | Hf | Ta | W | Re | Al | Others | Mdt | Bo |
| Alloys of this invention | A1 | 1.40 | 4.00 | 11.00 | Bal. | <0.1 | 0.12 | 6.80 | 5.50 | 4.40 | 5.40 | | 0.9779 | 0.6502 |
| | A2 | 1.40 | 6.00 | 11.00 | Bal. | <0.1 | 0.12 | 6.80 | 5.50 | 4.40 | 5.40 | | 0.9871 | 0.6678 |
| | A3 | 1.40 | 6.00 | 11.00 | Bal. | <0.1 | 0.12 | 6.80 | 5.50 | 3.60 | 5.40 | | 0.9842 | 0.6639 |
| | A4 | 1.40 | 5.00 | 11.00 | Bal. | <0.1 | 0.12 | 7.40 | 5.50 | 3.60 | 5.40 | | 0.9837 | 0.6581 |
| | A5 | 1.40 | 6.50 | 11.00 | Bal. | <0.1 | 0.12 | 7.40 | 5.50 | 3.60 | 5.40 | | 0.9907 | 0.6712 |
| | A6 | 1.40 | 4.00 | 11.00 | Bal. | 0.20 | 0.12 | 6.80 | 5.50 | 4.40 | 5.40 | | 0.9791 | 0.6517 |
| | A7 | 1.40 | 6.50 | 11.00 | Bal. | 0.40 | 0.12 | 7.40 | 5.50 | 3.60 | 5.40 | | 0.9932 | 0.6743 |
| | A8 | 1.40 | 5.00 | 11.00 | Bal. | <0.1 | 0.12 | 6.80 | 6.40 | 4.40 | 5.30 | | 0.9847 | 0.6638 |
| | A9 | 1.40 | 5.00 | 11.00 | Bal. | <0.1 | 0.12 | 6.80 | 6.40 | 4.40 | 5.30 | Ce: 20 ppm | 0.9847 | 0.6638 |
| | A10 | 1.40 | 5.00 | 11.00 | Bal. | <0.1 | 0.12 | 6.80 | 6.40 | 4.40 | 5.30 | Ce: 40 ppm | 0.9847 | 0.6638 |
| | A11 | 1.40 | 5.00 | 11.00 | Bal. | <0.1 | 0.12 | 6.80 | 6.40 | 4.40 | 5.30 | Ce: 100 ppm | 0.9847 | 0.6638 |
| | A12 | 1.40 | 5.00 | 11.00 | Bal. | <0.1 | 0.12 | 6.80 | 6.40 | 4.40 | 5.30 | Ce: 200 ppm | 0.9847 | 0.6638 |
| Alloys of comparative examples | B1 | 1.00 | 6.80 | 3.00 | Bal. | 1.20 | 0.12 | 6.50 | 6.40 | 3.80 | 5.40 | | 0.9860 | 0.6661 |
| | B2 | 0.70 | 6.50 | 8.00 | Bal. | 1.00 | 0.12 | 6.50 | 6.20 | 3.80 | 5.70 | | 0.9868 | 0.6678 |
| | B3 | 0.20 | 6.50 | 10.00 | Bal. | 1.00 | 0.12 | 6.80 | 5.80 | 4.20 | 6.00 | | 0.9870 | 0.6691 |
| | B4 | 0.20 | 6.00 | 10.00 | Bal. | 1.50 | 0.12 | 6.80 | 5.80 | 4.20 | 6.00 | | 0.9879 | 0.6685 |
| | B5 | 1.00 | 6.80 | 3.00 | Bal. | 1.60 | 0.12 | 6.50 | 6.40 | 3.80 | 5.40 | | 0.9885 | 0.6691 |
| | B6 | 1.40 | 5.00 | 11.00 | Bal. | 0.50 | 0.12 | 6.50 | 5.60 | 4.40 | 5.30 | | 0.9818 | 0.6620 |
| | B7 | 0.90 | 2.80 | 14.00 | Bal. | 1.40 | 0.12 | 7.00 | 5.50 | 5.50 | 5.60 | | 0.9837 | 0.6586 |
| | B8 | 1.80 | 6.00 | 1.00 | Bal. | 1.20 | 0.03 | 6.10 | 5.70 | 4.00 | 5.10 | | 0.9829 | 0.6563 |
| | B9 | 1.00 | 4.20 | 2.20 | Bal. | 1.90 | 0.14 | 7.70 | 5.90 | 5.50 | 5.00 | | 0.9807 | 0.6593 |
| | B10 | 1.70 | 7.80 | 3.50 | Bal. | 0.80 | — | 6.10 | 7.70 | 0.75 | 5.10 | | 0.9860 | 0.6671 |
| Existing alloys | C1 | 1.20 | 8.66 | — | Bal. | 1.23 | — | 8.15 | 7.04 | 0.78 | 5.39 | | 0.9849 | 0.6644 |
| | C2 | 1.00 | 6.50 | 9.00 | Bal. | 0.60 | 0.10 | 6.50 | 6.00 | 3.00 | 5.60 | | 0.9867 | 0.6679 |
| | C3 | — | 7.00 | 8.00 | Bal. | 2.00 | 0.20 | 7.00 | 5.00 | 3.00 | 6.20 | | 0.9890 | 0.6669 |
| | C4 | — | 3.00 | 12.00 | Bal. | 2.00 | 0.10 | 6.00 | 6.00 | 5.00 | 5.70 | | 0.9655 | 0.6495 |
| | C5 | 0.70 | 6.00 | 9.30 | Bal. | 0.50 | 1.40 | 3.40 | 8.50 | 3.00 | 5.70 | | 0.9850 | 0.6630 |
| | C6 | 5.00 | 13.90 | 9.50 | Bal. | 1.50 | — | 2.80 | 3.70 | — | 3.00 | | 0.9903 | 0.7202 |

Table 2 lists the contents of C, Si, Mn, P, S, B, Zr, O, and N in molten ingots. The alloys of this invention and comparative examples are all single-crystal alloys.

The existing alloys have been already put to actual use. Existing alloys C1 to C4 are single-crystal alloys and existing alloys C5 to C6 are unidirectional solidification alloys.

We prepared each alloy ingot (70 mm in diameter by 200 mm long) by mixing the preset raw materials in a 15 kg-capacity refractory crucible, and melting them in the vacuum induction furnace. Then we prepared single-crystal test pieces and unidirectional solidification test pieces by casting in a mold-drawing unidirectional solidification method.

Single-crystal test pieces and unidirectional solidification test pieces are cast into an alumina ceramic mold under the following conditions: mold heating temperature of 1540° C.; mold drawing speed of 20 cm/hour; in vacuum. The single-crystal test pieces are prepared by using the selector method. The crystal growth directions of the cast single-crystal test pieces are all within 10° relative to <001>.

TABLE 2

| | | Impurity (% by weight), [O] [N] (ppm) | | | | | | | | |
|---|---|---|---|---|---|---|---|---|---|---|
| Type | No. | C | Si | Mn | P | S | B | Zr | O | N |
| Alloys of this invention | A1 | 0.001 | 0.002 | 0.001 | <0.0010 | <0.0010 | 0.0006 | <0.001 | 6 | 5 |
| | A2 | 0.001 | 0.002 | 0.001 | <0.0010 | <0.0010 | 0.0006 | <0.001 | 6 | 5 |
| | A3 | 0.001 | 0.002 | 0.001 | <0.0010 | <0.0010 | 0.0006 | <0.001 | 6 | 5 |
| | A4 | 0.001 | 0.002 | 0.001 | <0.0010 | <0.0010 | 0.0006 | <0.001 | 6 | 5 |
| | A5 | 0.001 | 0.002 | 0.001 | <0.0010 | <0.0010 | 0.0006 | <0.001 | 6 | 5 |
| | A6 | 0.001 | 0.002 | 0.001 | <0.0010 | <0.0010 | 0.0006 | <0.001 | 6 | 5 |
| | A7 | 0.001 | 0.002 | 0.001 | <0.0010 | <0.0010 | 0.0006 | <0.001 | 6 | 5 |
| | A8 | 0.001 | 0.002 | 0.001 | <0.0010 | <0.0010 | 0.0006 | <0.001 | 6 | 5 |
| | A9 | 0.001 | 0.002 | 0.001 | <0.0010 | <0.0010 | 0.0006 | <0.001 | 6 | 5 |
| | A10 | 0.001 | 0.002 | 0.001 | <0.0010 | <0.0010 | 0.0006 | <0.001 | 6 | 5 |

TABLE 2-continued

| Type | No. | Impurity (% by weight), [O] [N] (ppm) | | | | | | | | |
|---|---|---|---|---|---|---|---|---|---|---|
| | | C | Si | Mn | P | S | B | Zr | O | N |
| | A11 | 0.001 | 0.002 | 0.001 | <0.0010 | <0.0010 | 0.0006 | <0.001 | 6 | 5 |
| | A12 | 0.001 | 0.002 | 0.001 | <0.0010 | <0.0010 | 0.0006 | <0.001 | 6 | 5 |
| Alloys of comparative examples | B1 | 0.002 | 0.003 | 0.001 | <0.0010 | <0.0010 | 0.0005 | <0.001 | 7 | 5 |
| | B2 | 0.003 | 0.003 | 0.003 | <0.0010 | <0.0010 | 0.0005 | <0.001 | 7 | 3 |
| | B3 | 0.002 | 0.005 | 0.001 | <0.0010 | <0.0010 | 0.0007 | <0.001 | 6 | 4 |
| | B4 | 0.001 | 0.006 | 0.001 | <0.0010 | <0.0010 | 0.0010 | <0.001 | 6 | 3 |
| | B5 | 0.001 | 0.002 | 0.001 | <0.0010 | <0.0010 | 0.0006 | <0.001 | 6 | 5 |
| | B6 | 0.001 | 0.002 | 0.001 | <0.0010 | <0.0010 | 0.0006 | <0.001 | 6 | 5 |
| | B7 | 0.0010 | 0.0060 | <0.0020 | <0.0010 | <0.0010 | 0.0010 | 0.0040 | 8 | 2 |
| | B8 | 0.0040 | 0.0040 | <0.0020 | <0.0010 | 0.0002 | 0.0013 | <0.0010 | 5 | 5 |
| | B9 | 0.0040 | <0.0010 | <0.0020 | 0.0010 | 0.0001 | 0.0011 | <0.0010 | 5 | 3 |
| | B10 | 0.0040 | 0.0040 | <0.0020 | 0.0010 | 0.0001 | <0.0010 | <0.0010 | 7 | 5 |
| Existing alloys | C1 | — | — | — | — | — | — | — | — | — |
| | C2 | 0.0025 | 0.0110 | 0.0030 | <0.0050 | 0.0003 | 0.0025 | 0.0010 | 2 | 1 |
| | C3 | — | — | — | — | — | — | — | — | — |
| | C4 | 0.0010 | <0.10 | <0.05 | <0.0030 | 0.0003 | <0.0020 | <0.010 | 5 | 3 |
| | C5 | 0.0700 | <0.10 | <0.010 | 0.0002 | 0.0001 | 0.0150 | 0.0070 | 2 | 2 |
| | C6 | 0.1000 | 0.0200 | <0.010 | 0.0020 | 0.0060 | 0.0140 | 0.0210 | 15 | 3 |

Table 3 lists conditions of solution treatments and age heat treatments for the single-crystal test pieces and unidirectional solidification test pieces. These conditions were determined judging from macro and microstructures after preliminary tests.

By machining the heat-treated single-crystal alloys and unidirectional solidification alloys, we prepared creep rupture test pieces of 6.0 mm in diameter (measured at the parallel section) by 30 mm long (parallel section), hot oxidation resistance test pieces of 25 mm long by 10 mm wide by 1.5 mm thick, and hot corrosion resistance test pieces of 8 mm in diameter by 40 mm long.

TABLE 3

| Type | No. | Solution heat treatment condition | Aging condition: First aging | Aging condition: Second aging |
|---|---|---|---|---|
| Alloys of this invention | A1 | 1300 to 1320° C./ 4 to 16 h | 1140 to 1180° C./ 4 h, AC | 871° C./20 h, AC |
| | A2 | | | |
| | A3 | | | |
| | A4 | | | |
| | A5 | | | |
| | A6 | | | |
| | A7 | | | |
| | A8 | | | |
| | A9 | | | |
| | A10 | | | |
| | A11 | | | |
| | A12 | | | |
| Alloys of comparative examples | B1 | 1300 to 1320° C./ 4 to 16 h | 1100 to 1120° C./ 4 h, AC | 871° C./20 h, AC |
| | B2 | | | |
| | B3 | | | |
| | B4 | | | |
| | B5 | 1310° C./16 h + 1320° C./8 h | | |
| | B6 | 1300 to 1320° C./4 to 16 h | 1160° C./4 h, AC | |
| | B7 | 1320° C./12 h + 1325° C./12 h + 1330° C./ 24 h | 1120° C./4 h, AC | |
| | B8 | 1310° C./12 h + 1320° C./12 h + 1330° C./ 24 h + 1325° C./24 h | 1100° C./4 h, AC | |
| | B9 | 1310° C./12 h + 1320° C./12 h + 1330° C./ 24 h + 1340° C./24 h + 1335° C./ 24 h | 1120° C./4 h, AC | |
| | B10 | 1310° C./12 h + 1320° C./12 h | 1140° C./4 h, Slow cooling | |
| Existing alloys | C1 | 1320° C./5 h | 1050° C./16 h | 850° C./48 h |
| | C2 | 1277° C./2 h + 1288° C./2 h + 1296° C./ 3 h + 1304° C./3 h + 1313° C./ 2 h + 1316° C./2 h + 1318° C./ 2 h + 1321° C./2 h | 1080° C./4 h, AC | 871° C./20 h, AC |
| | C3 | 1310° C./2 h | | 900° C./16 h |
| | C4 | 1300° C./1 h + 1320° C./5 h | 1150° C./4 h | 871° C./20 h AC |
| | C5 | None | 1080° C./4 h, AC | |
| | C6 | 1121° C./2 h | 843° C./24 h, AC | None |

Table 4 lists conditions of creep rupture, hot oxidation resistance, and hot corrosion resistance tests. The creep rupture tests were done under two conditions: 137 MPa at 1313 K and 206 MPa at 1255 K. The oxidation tests at 1313 K and 1193 K were done by repeatedly oxidizing the test pieces for 600 hours until the total oxidizing time becomes 3000 hours. The weights of the test pieces are measured at each 600 hours and they are compared with those before oxidization. The hot corrosion resistance tests were done by repeatedly keeping the test pieces at 900° C. for 7 hours in a combustion gas containing 80 ppm of sodium chloride (NaCl). The weights of the test pieces are measured after the tests and they are compared with those before oxidization.

TABLE 4

| Evaluation test | Test condition |
|---|---|
| Creep rupture test | Test temperatures and stresses<br>(1) 1313 K - 137 MPa<br>(2) 1255 K - 206 MPa |
| Oxidation resistance test | Continuous oxidization in the atmosphere<br>(1) Temperature of 1313 K and time of 3000 hours (600 hours by 5 times)<br>(2) Temperature of 1193 K and time of 3000 hours (600 hours by 5 times) |
| Corrosion resistance test | Corrosion in hot gas<br>(1) Temperature of 1173 K and time of 35 hours (7 hours by 5 times)<br>* Fuel: Diesel oil containing NaCl of 80 ppm |

Table 5 lists the results of these tests. As seen in Table 5, it is apparent that the alloys of this invention (A1 to A12) show the creep rupture lives improved greatly in comparison with the alloys of the comparative examples (B1 to B10), and existing alloys (C1 to C6). Also, the alloys of this invention (A1 to A12) show much less in the weight losses after oxidation and corrosion tests than the other alloys. The alloy B6 (of comparative example) has approximately the same creep rupture life and corrosion weights as those of the alloys of this invention, but the alloy B6 contains more molybdenum (0.5%) than any of the alloys of this invention and is apt to be oxidized more easily. Similarly, the existing alloy C2 has approximately the same weight losses after the oxidation and corrosion tests as those of the alloys of this invention. The alloy C2 contains a larger amount of molybdenum (0.6%) than any of the alloys of this invention. As a result, the creep rupture life of the alloy C2 at 1255 K is strikingly shorter than that of the alloys of this invention.

In addition, the alloys of this invention show better hot corrosion resistance than the existing alloy C1 and show higher creep rupture strength than the existing alloy C3. Similarly, the alloys of this invention have superior in the both oxidation resistance and corrosion resistance to the existing alloy C4, although their creep rupture strength is a little inferior to that of the alloy C4. With these, it is obvious that the alloys of this invention are well-balanced alloys.

Furthermore, it is clear from the test results of alloys A9 to A12 that a slight addition of cerium (20 to 200 ppm), which is one of rare-earth elements to the alloys of this invention, greatly improves the oxidation resistance of the alloys without deteriorating the creep rupture strength and corrosion resistance of the alloys. In other words, the effect of addition of cerium to alloys of this invention becomes remarkable in these inventive alloys containing no molybdenum.

TABLE 5

| | | Creep rupture time (h) | | Weight difference before and after oxidation test (mg/cm$^2$) +: increased −: decreased | | Status after corrosion test: Weight difference (mg/cm$^2$) | |
|---|---|---|---|---|---|---|---|
| Type | No. | 1313 K-137 MPa | 1255 K-206 MPa | 1313 K-3000 h | 920° C./3000 h | +: increased −: decreased | Appearance*[1] |
| Alloys of this invention | A1 | 791.8 | 810.3 | −8.974 | 1.587 | 1.052 | ○ |
| | A2 | 1034.5 | 897.5 | 0.198 | 0.711 | 0.861 | ◎ |
| | A3 | 828.9 | 688.3 | −28.430 | 0.843 | 0.921 | ◎ |
| | A4 | 868.7 | 824.2 | −1.488 | 0.925 | 1.949 | ○ |
| | A5 | 971.9 | 818.2 | −17.322 | 1.008 | 1.068 | ○ |
| | A6 | 852.1 | 850.9 | −12.279 | 1.421 | 1.225 | ○ |
| | A7 | 1013.5 | 832.4 | −22.281 | 1.041 | 1.756 | ○ |
| | A8 | 1030.5 | 795.1 | −30.430 | 0.859 | 0.000 | ◎ |
| | A9 | 985.6 | 765.1 | 1.289 | 0.876 | 0.013 | ◎ |
| | A10 | 895.7 | 771.6 | 1.173 | 0.727 | 0.032 | ◎ |
| | A11 | 1062.1 | 820.4 | 1.140 | 0.793 | 0.142 | ◎ |
| | A12 | 975.6 | 883.1 | 1.025 | 0.909 | 0.034 | ◎ |
| Alloys of comparative examples | B1 | 553.6 | 740.0 | −10.182 | 1.107 | −0.053 | ○ |
| | B2 | 345.8 | 266.5 | −12.066 | 0.744 | 20.076 | XX |
| | B3 | 257.8 | 300.3 | −5.967 | 0.744 | −0.461 | Δ |
| | B4 | 251.0 | 275.0 | −10.512 | 0.727 | −0.212 | Δ |
| | B5 | 437.3 | 801.5 | −11.835 | 1.355 | −0.507 | Δ |
| | B6 | 1010.6 | 894.6 | −48.198 | 1.107 | −0.211 | Δ |
| | B7 | 1165.1 | 1176.6 | −145.851 | 1.157 | 11.501 | X |
| | B8 | 345.0 | 365.6 | −7.636 | −0.486 | 1.060 | ○ |
| | B9 | 287.5 | 240.7 | −46.155 | −3.006 | 0.517 | ○ |
| | B10 | 116.4 | 83.1 | −18.777 | −2.614 | −7.716 | XX |
| Existing alloys | C1 | 936 | — | — | — | −66.534 | XX |
| | C2 | 726.0 | 491.8 | −16.694 | 0.727 | 0.807 | ○ |
| | C3 | 720.0 | 545.0 | — | — | — | — |
| | C4 | 1260.0 | 1066.0 | −67.587 | 2.678 | 11.501 | Δ |

TABLE 5-continued

| Type | No. | Creep rupture time (h) | | Weight difference before and after oxidation test (mg/cm$^2$) +: increased −: decreased | | Status after corrosion test Weight difference (mg/cm$^2$) +: increased −: decreased | Appearance*1 |
|---|---|---|---|---|---|---|---|
| | | 1313 K-137 MPa | 1255 K-206 MPa | 1313 K-3000 h | 920° C./3000 h | | |
| | C5 | 192.0 | 176.7 | −1.207 | 1.174 | 13.133 | X |
| | C6 | 42.5 | 40.0 | −64.116 | 3.091 | −81.939 | XX |

◎: Excellent
○: Good
Δ: Holes made by corrosion
X: Bad
XX: Worst

FIG. 1 is a diagram showing the relationship between creep rupture time and quantity of corrosion at 1313 K. From FIG. 1, it is obvious that the alloy of this invention A1 to A12 show the creep rupture lives greatly improved in comparison with the alloys of comparative examples B1 to B10 and the existing alloys C1 to C6 and that the alloys A1 to A12 show very little weight losses after the hot corrosion tests. The characteristics of the comparative example alloy B6 was already explained above.

Figure 2:
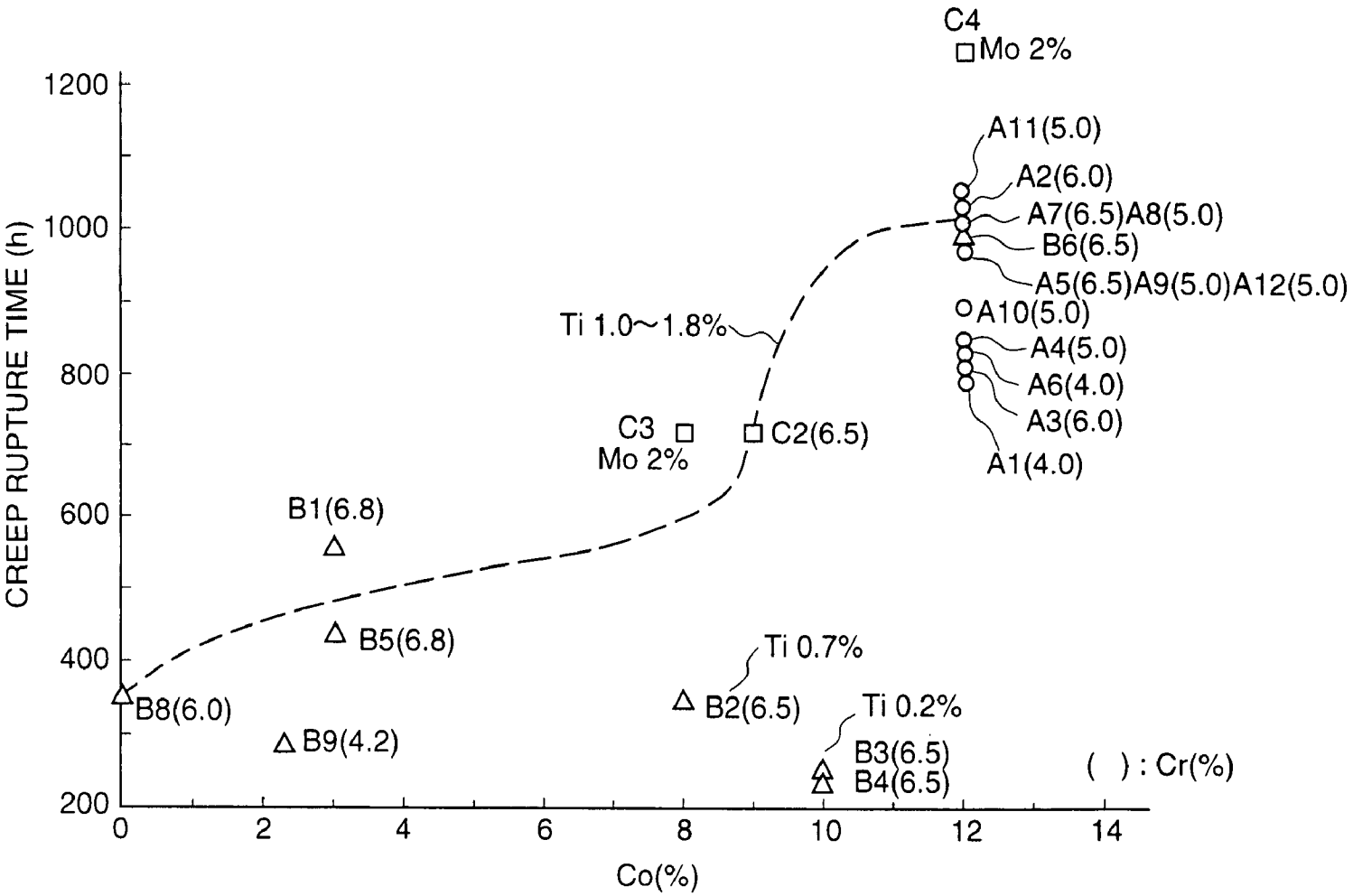
FIG. 2 is a diagram showing the relationship between creep rupture time at 1313 K and content of cobalt in alloys.

FIG. 2 is a diagram showing the relationship between creep rupture time at 1313 K and the content of cobalt in alloys. From FIG. 2, it is obvious that the alloys of this invention show higher creep rupture strength as increasing the cobalt content (see the dotted line of 6.5% chromium) and that the extremely high creep rupture strength can be obtained when the alloys contain 9.5% cobalt or more. However, when the content of titanium is less than 0.8%, the creep rupture strength decreases even when the content of cobalt is high.

Figure 3:
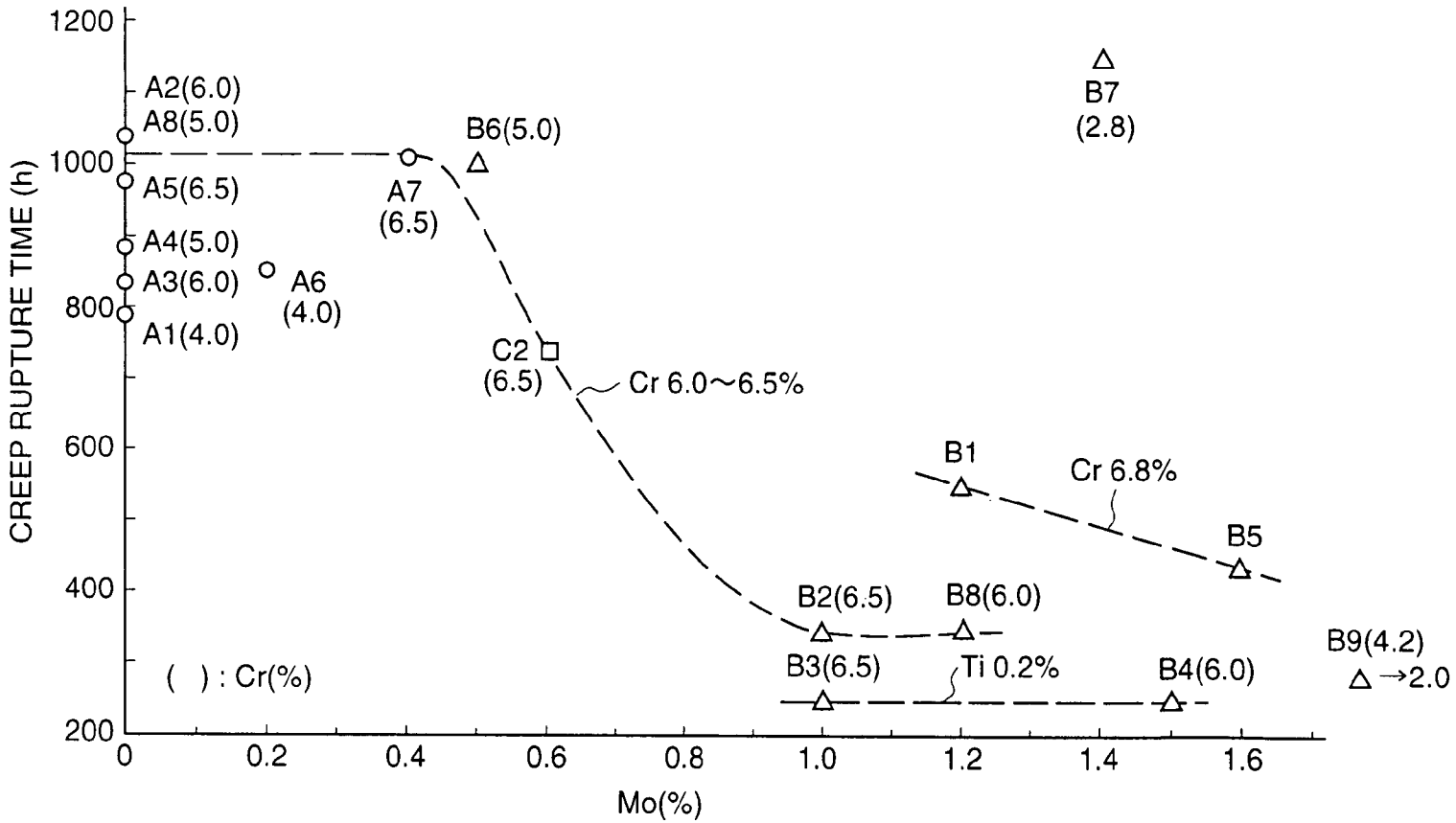
FIG. 3 is a diagram showing the relationship between creep rupture time at 1313 K and content of molybdenum in alloys.

FIG. 3 is a diagram showing the relationship between creep rupture time at 1313 K and the content of molybdenum in alloys free from cerium. From FIG. 3, it is obvious that the alloys of this invention (see the dotted line of 6.5% chromium) show higher creep rupture strength as increasing the content of molybdenum as long as the content of molybdenum is less than 0.5% but the alloys C2, B2, and B8 drops the creep rupture strength strikingly as increasing the content of molybdenum.

Figure 4:
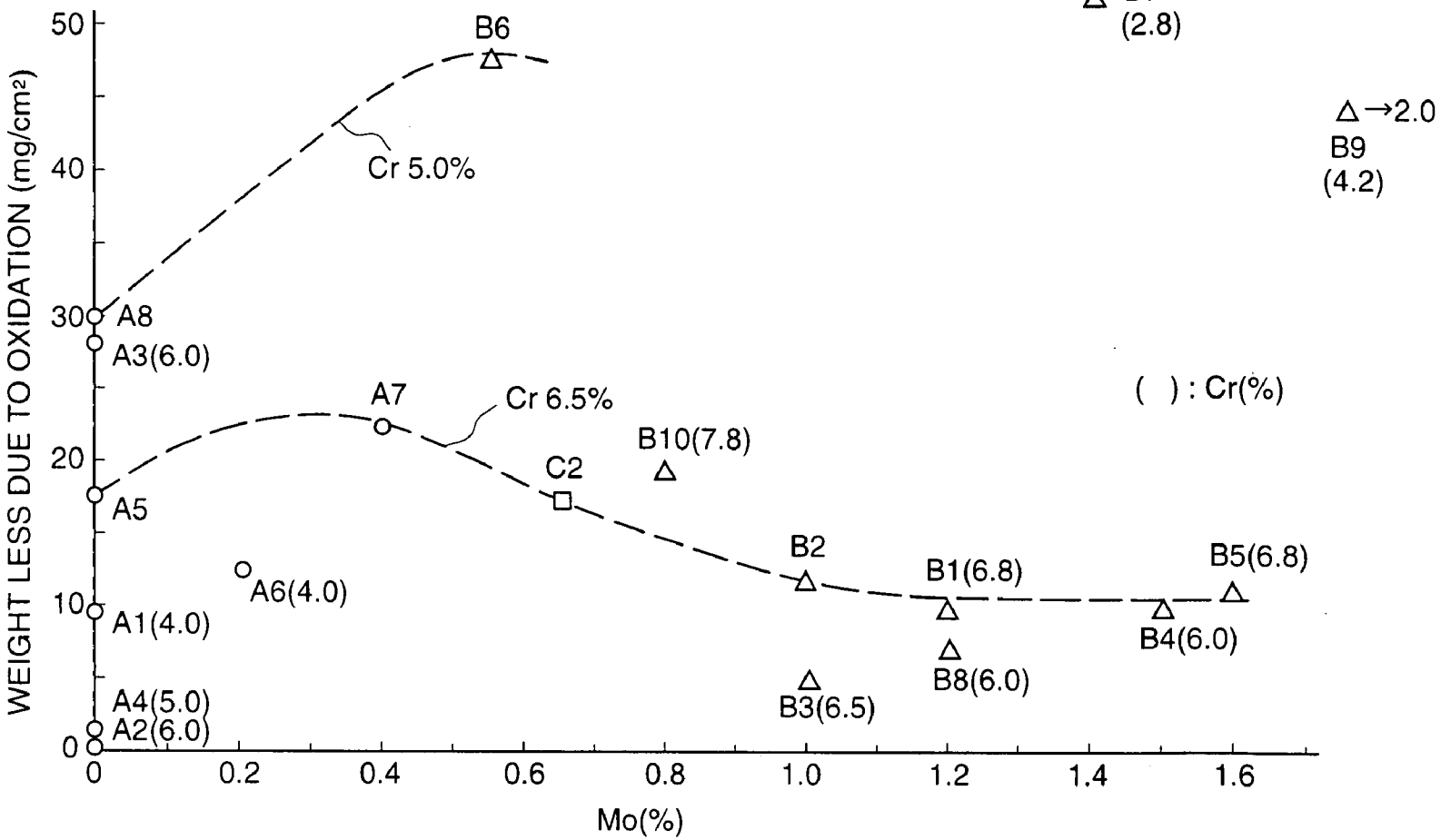
FIG. 4 is a diagram showing the relationship between weight loss after a oxidation test at 1313 K and content of molybdenum in alloys.

FIG. 4 is a diagram showing the relationship between weight losses after the oxidation test at 1313 K and the content of molybdenum in alloys free from cerium. From FIG. 4, it is obvious that the alloys of this invention containing about 5.0% and 6.5% chromium show greater weight losses near at 0.5% of molybdenum and strikingly reduce their oxidation resistance. Further, it is obvious that the alloy containing a small amount of molybdenum (less than 0.5%) shows high oxidation resistance when the content of chromium is about 4% but addition of more than 0.5% molybdenum will reduce the oxidation resistance of the alloy strikingly.

As explained above, the alloys of this invention show long creep rupture lives, high corrosion resistance and high oxidation resistance at high temperatures. Contrarily, the alloys of comparative examples B1 to B10 and existing alloys C1 to C6, which do not satisfy the major component ranges of this invention, exhibit short creep rupture lives, low hot oxidation resistance and corrosion resistance as compared with the inventive alloys and cannot be well balanced in all of such characteristics. Naturally, it is obvious that the alloys of this invention superior in all of the creep rupture strength, oxidation resistance, and corrosion resistance at high temperatures to the examples and the existing alloys.

The single-crystal nickel-based superalloys of this invention have high creep rupture strength at high temperatures and excellent both corrosion resistance and oxidation resistance at high temperatures. Therefore, these superalloys have enough alloy properties to be applied to power engines such as jet engines and gas turbines that require higher turbine inlet temperatures for higher performance and efficiency.

What is claimed is:

1. A single-crystal nickel-based superalloy with high temperature strength, hot corrosion resistance and oxidation resistance comprising by weight, 3.0 to 7.0% Cr, 9.5 to 15.0% Co, 4.5 to 8.0% W, 3.3 to 6.0% Re, 4.0 to 8.0% Ta, 0.8 to 2.0% Ti, 4.5 to 6.5% Al, 0.01 to 0.2% Hf, less than 0.4% Mo, 0.01% or less C, 0.0005 to 0.001% B, 0.01% or less Zr, 0.0001 to 0.001% O, 0.0001 to 0.001% N, and the balance substantially Ni.

2. A single-crystal nickel-based superalloy with high temperature strength, hot corrosion resistance and oxidation resistance of claim 1, wherein the composition contains by weight, 3.5 to 7.0% Cr, 10.1 to 13.5% Co, 3.3 to 5.5% Re, 6.1 to 8.0% Ta, 1.0to2.0% Ti, and 03 to 0.15% Hf.

3. A single-crystal nickel-based superalloy with high temperature strength, hot corrosion resistance and oxidation resistance of claim 1, wherein the composition contains by weight, 3.8 to 6.8% Cr, 10.1 to 12.5% Co, 4.8 to 7.0% W, 3.3 to 4.9% Re, 6.1 to 8.0% Ta, 1.2to 1.8% Ti, and 0.03 to 0.15% Hf.

4. A single-crystal nickel-based superalloy with high temperature strength, hot corrosion resistance and oxidation resistance of claim 3, wherein the composition contains less than 0.1% by weight of Mo.

5. A single-crystal nickel-based superalloy with high temperature strength, hot corrosion resistance and oxidation resistance of any one of claims 1 to 4, wherein the Mdt value obtained by atomic fractions of the elements is 0.975 to 0.995 and the Bo value is 0.650 to 0.675

$$Mdt=1.142\times(Cr)+0.777\times(Co)+1.655\times(W)+1.550\times(Mo)+1.267\times(Re)+2.224\times(Ta)+2.271\times(Ti)+1.900\times(Al)+0.717\times(Ni)$$

$$Bo=1.278\times(Cr)+0.697\times(Co)+1.730\times(W)+1.611\times(Mo)+1.692\times(Re)+1.670\times(Ta)+1.098\times(Ti)+0.533\times(Al)+0.514\times(Ni).$$

6. A single-crystal nickel-based superalloy with high temperature strength, hot corrosion resistance and oxidation resistance of claim 1, wherein the composition contains by weight 0.0005 to 0.001% O.

7. A single-crystal nickel-based superalloy with high temperature strength, hot corrosion resistance and oxidation resistance comprising by weight, 3.0 to 7.0% Cr, 9.5 to 15.0% Co, 4.5 to 8.0% W, 3.3 to 6.0% Re, 4.0 to 8.0% Ta, 0.8 to 2.0% Ti, 4.5 to 6.5% Al, 0.01 to 0.2% Hf, less than 0.4% Mo, 0.01% or less C, 0.0005 to 0.001% B, 0.01% or less Zr, 0.0001 to 0.001% O, 0.0001 to 0.001% N, 1 to 500 ppm of rare-earth elements, and balance substantially Ni.

8. A single-crystal nickel-based superalloy with high temperature strength, hot corrosion resistance and oxidation resistance of claim 7, wherein the rare-earth elements is 10 to 50 ppm.

9. A single-crystal nickel-based superalloy with high temperature strength, hot corrosion resistance and oxidation resistance of claim 7, wherein the rare-earth element is Y or Ce.

10. A single-crystal nickel-based superalloy with high temperature strength, hot corrosion resistance and oxidation resistance of claim 7, wherein the composition contains by weight 0.0005 to 0.001% O.

11. A single-crystal nickel-based superalloy with high temperature strength, hot corrosion resistance and oxidation resistance comprising by weight, 3.0 to 7.0% Cr, 9.5 to 15.0% Co, 4.5 to 8.0% W, 3.3 to 6.0% Re, 4.0 to 8.0% Ta, 0.8 to 2.0% Ti, 4.5 to 6.5% Al, 0.01 to 0.2% Hf, less than 0.4% Mo, 0.01% or less C, 0.0005 to 0.001% or less B, 0.01% or less Zr, 0.0001 to 0.001% O, 0.0001 to 0.001% N, 1 to 500 ppm of rare-earth elements, and balance substantially Ni, wherein a matrix is a substantial single-crystal microstructure of γ in which a γ' is precipitated.

12. A single-crystal nickel-based superalloy with high temperature strength, hot corrosion resistance and oxidation resistance of claim 11, wherein the composition contains by weight 0.0005 to 0.001% O.

* * * * *